US006318682B1

(12) United States Patent
Chen

(10) Patent No.: US 6,318,682 B1
(45) Date of Patent: Nov. 20, 2001

(54) SUPPORT BASE FOR A GOLF BAG

(76) Inventor: Chiu-Teh Chen, P.O. Box 63-247, Taichung (TW)

( * ) Notice: Subject to any disclaimer, the term of this patent is extended or adjusted under 35 U.S.C. 154(b) by 0 days.

(21) Appl. No.: 09/624,289

(22) Filed: Jul. 24, 2000

(51) Int. Cl.[7] ..... A63B 55/00
(52) U.S. Cl. ..... 248/96; 211/70.2
(58) Field of Search ..... 248/96, 97, 166, 248/168, 688; 206/315.7, 315.3, 315.2; 211/70.2

(56) References Cited

U.S. PATENT DOCUMENTS

| | | | | |
|---|---|---|---|---|
| Re. 35,684 | * | 12/1997 | Maeng | 248/96 |
| Re. 36,366 | * | 11/1999 | Suk | 248/96 |
| 1,757,471 | * | 5/1930 | Platt | 248/96 |
| 1,924,182 | * | 8/1933 | Fritz | 248/96 |
| 5,152,483 | * | 10/1992 | Maeng | 248/96 |
| 5,154,377 | * | 10/1992 | Suk | 248/96 |
| 5,156,366 | * | 10/1992 | Anderson | 248/96 |
| 5,236,085 | * | 8/1993 | Quellais | 206/315.7 |
| 5,340,063 | * | 8/1994 | Hsieh | 248/96 |
| 5,351,921 | * | 10/1994 | Chen | 248/96 |
| 5,415,285 | * | 5/1995 | Reimers | 206/315.7 |
| 5,464,180 | * | 11/1995 | Cheng | 248/96 |
| 5,507,384 | * | 4/1996 | Maeng | 206/315.7 |
| 5,516,064 | * | 5/1996 | Hsieh | 248/96 |
| 5,549,263 | * | 8/1996 | Maeng | 248/96 |
| 5,607,128 | * | 3/1997 | Suk | 248/96 |
| 5,634,616 | * | 6/1997 | Wang et al. | 248/96 |
| 5,673,879 | * | 10/1997 | Hsieh | 248/96 |
| 5,816,544 | * | 10/1998 | Hsieh | 248/96 |
| 5,823,485 | * | 10/1998 | Park | 248/96 |
| 5,829,719 | * | 11/1998 | Han | 248/96 |
| 5,829,720 | * | 11/1998 | Shiao | 248/96 |
| 5,857,567 | * | 1/1999 | Cheng | 206/315.7 |
| 5,860,521 | * | 1/1999 | Wu | 206/315.7 |
| 5,887,833 | * | 3/1999 | Sundara et al. | 248/96 |
| 5,901,845 | * | 5/1999 | Cheng | 206/315.7 |
| 5,934,624 | * | 8/1999 | Suk | 248/96 |
| 6,062,383 | * | 5/2000 | Han | 206/315.7 |
| 6,164,606 | * | 12/2000 | Sundara et al. | 248/96 |
| 6,227,503 | * | 5/2001 | Chen | 248/96 |
| 6,241,201 | * | 6/2001 | Wang | 248/96 |
| 6,241,202 | * | 6/2001 | Chen | 248/96 |

* cited by examiner

*Primary Examiner*—Daniel P. Stodola
*Assistant Examiner*—Jennifer E. Novosad
(74) *Attorney, Agent, or Firm*—Alan Kamrath; Rider, Bennett, Egan & Arundel, LLP

(57) ABSTRACT

A support base is mounted to a golf bag of the type having a substantially U-shaped resilient defined by a mediate section and two limbs. The support base has two parallel side passages in a top side thereof. The support base further has a cutout in a lateral side thereof. The cutout and the side passages being communicated with each other and arranged to define a tongue with the side passages located on both sides of the tongue. Each side passage includes an open outer end and a closed inner end. An end wall defining the inner end of each side passage includes an inclined groove. The cutout includes an outer open end and an inner end that is aligned with the closed inner ends of the side passages. The outer end of the cutout allows insertion of the mediate section of the resilient member into the closed inner end of the cutout until each of the limbs of the resilient member reaches the closed inner end of an associated one of the side passages, thereby allowing the limbs to be pivoted into the inclined grooves for supporting the golf bag in a tilt position.

3 Claims, 7 Drawing Sheets

SUPPORT BASE FOR A GOLF BAG

BACKGROUND OF THE INVENTION

1. Field of the Invention

The present invention relates to a support base for a golf bag.

2. Description of the Related Art

FIG. 6 of the drawings illustrates a conventional support base 16 for a golf bag 12, wherein the support base 16 is rotated through 90° for supporting the golf bag 12 in a tilt status. Nevertheless, the support base 16 might be rotated inadvertently and a support leg 14 of the support base 16 tends to be broken when the support leg 14 is inadvertently moved to a position shown in FIG. 7. The present invention is intended to provide a support base that solves this problem.

SUMMARY OF THE INVENTION

A support base in accordance with the present invention is mounted to a golf bag of the type having a substantially U-shaped resilient defined by a mediate section and two limbs. The support base comprises two parallel side passages in a top side thereof. The support base further comprises a cutout in a lateral side thereof. The cutout and the side passages being communicated with each other and arranged to define a tongue with the side passages located on both sides of the tongue. Each side passage includes an open outer end and a closed inner end. An end wall defining the inner end of each side passage includes an inclined groove. The cutout includes an outer open end and an inner end that is aligned with the closed inner ends of the side passages. The outer end of the cutout allows insertion of the mediate section of the resilient member into the closed inner end of the cutout until each of the limbs of the resilient member reaches the closed inner end of an associated one of the side passages, thereby allowing the limbs to be pivoted into the inclined grooves for supporting the golf bag in a tilt position.

The outer open end of the cutout is located at a level higher than that of the inner end of the cutout. The mediate section of the resilient member is pivotally received in the outer open end of the cutout.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
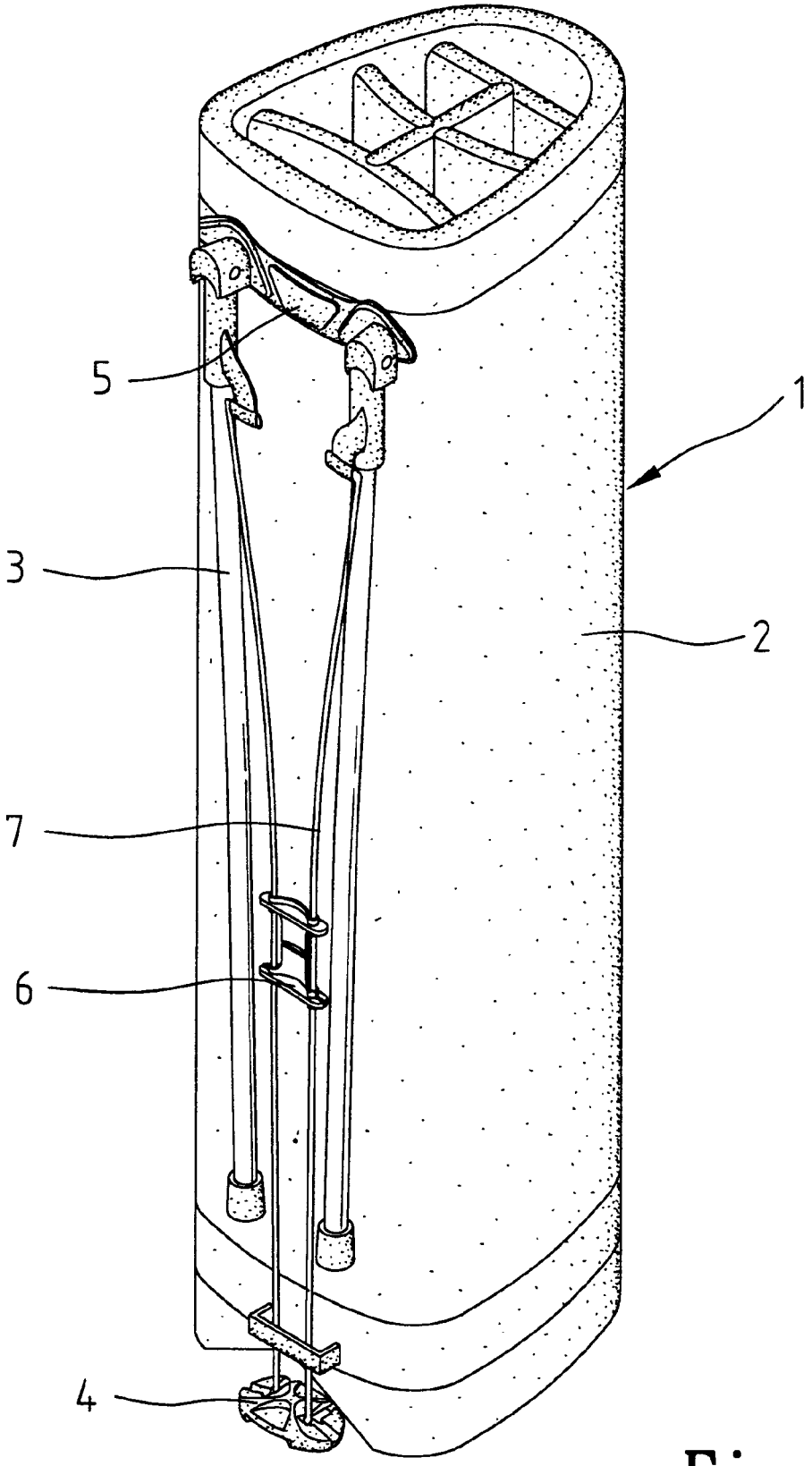
FIG. 1 is a perspective view of a golf bag with a support base in accordance with the present invention.
Figure 2:
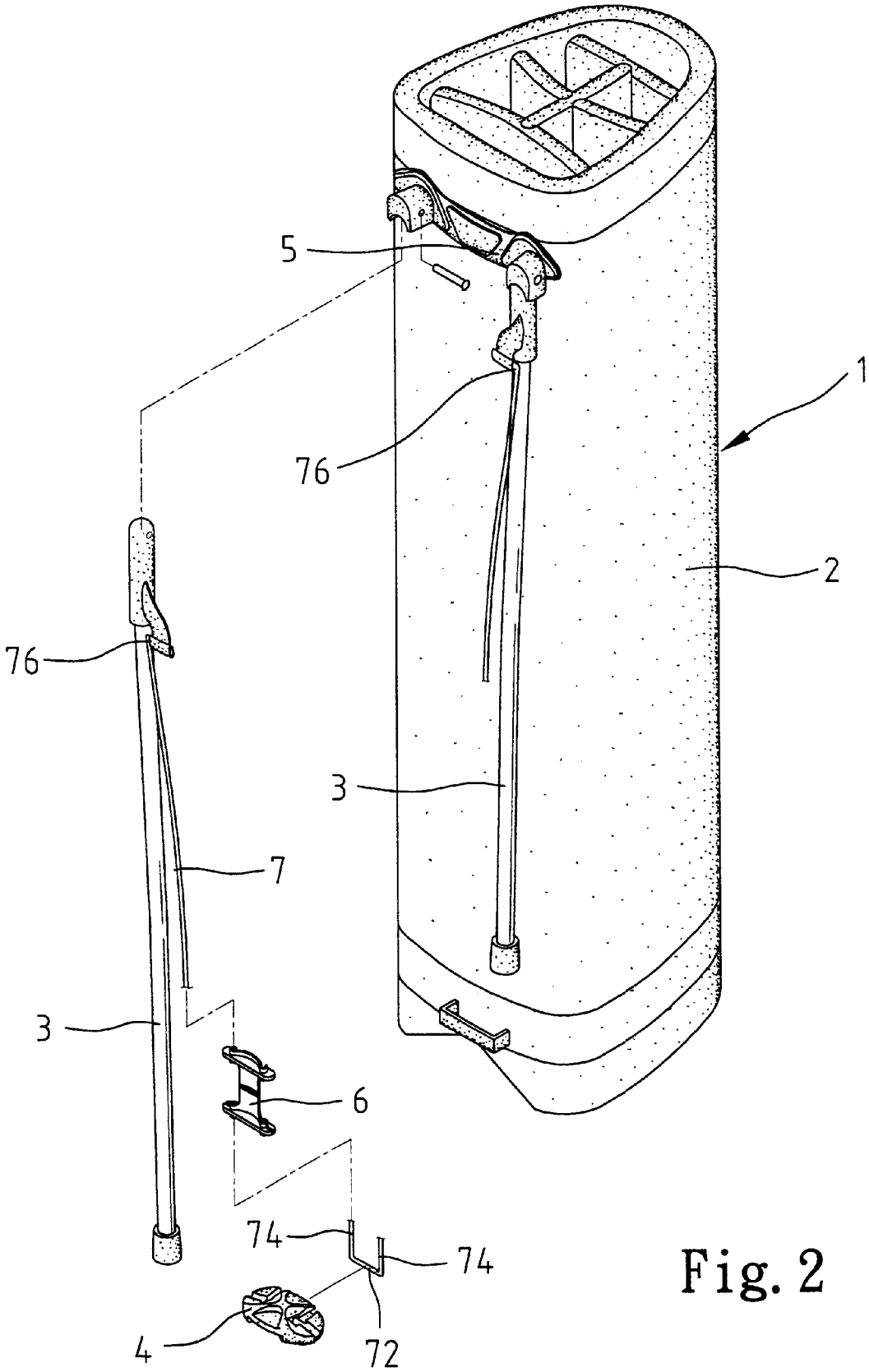
FIG. 2 is a perspective view, partly exploded, of the golf bag in FIG. 1.

Referring to FIGS. 1 through 5 and initially to FIGS. 1 and 2, a golf bag 1 generally includes a bag 2, a mounting member 5 attached to the bag 2, two legs 3, a tensioner 6, a substantially U-shape resilient member 7, and a support base 4, wherein the support base 4 is the main feature of the present invention. The U-shape resilient member 7 includes a mediate section 72 and two limbs 74 each having a distal end 76 connected to an upper end of an associated leg 3 to move therewith.

Figure 3:
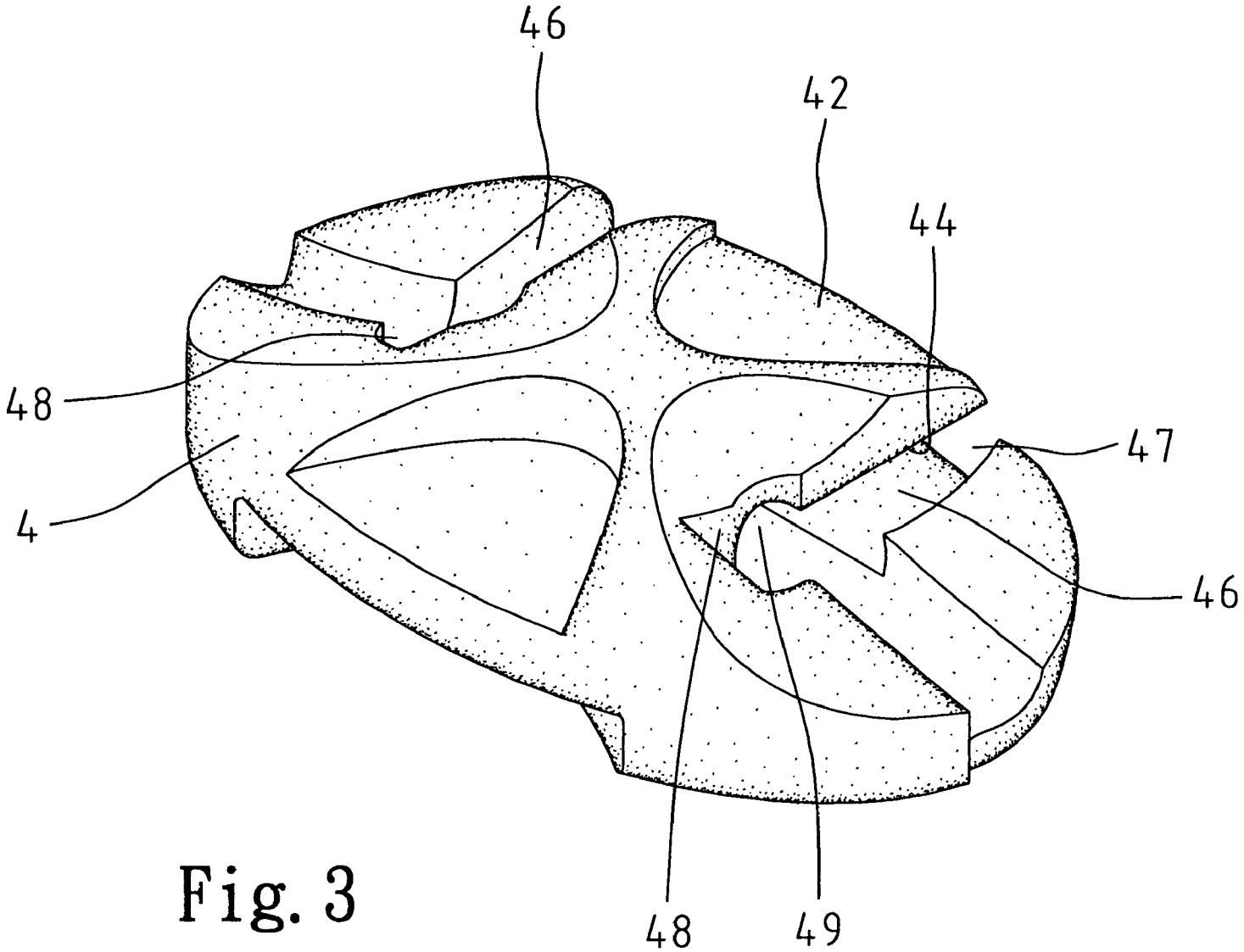
FIG. 3 is a perspective view of the support base in accordance with the present invention.

Referring to FIG. 3, the support base 4 includes two parallel side passages 46 in a top side thereof and a cutout 44 in a lateral side thereof. The cutout 44 and the side passages 46 communicate with each other to and arranged to thereby define a tongue 42 with the side passages 46 located on both sides of the tongue 42. Each side passage 46 includes an open outer end 47 and a closed inner end 49, wherein an end wall defining the inner end 49 includes an inclined groove 48. The cutout 44 also includes an open outer end (not labeled) and an inner end (not labeled) that is aligned with the closed inner ends 49 of the side passages 46.

Figure 4:
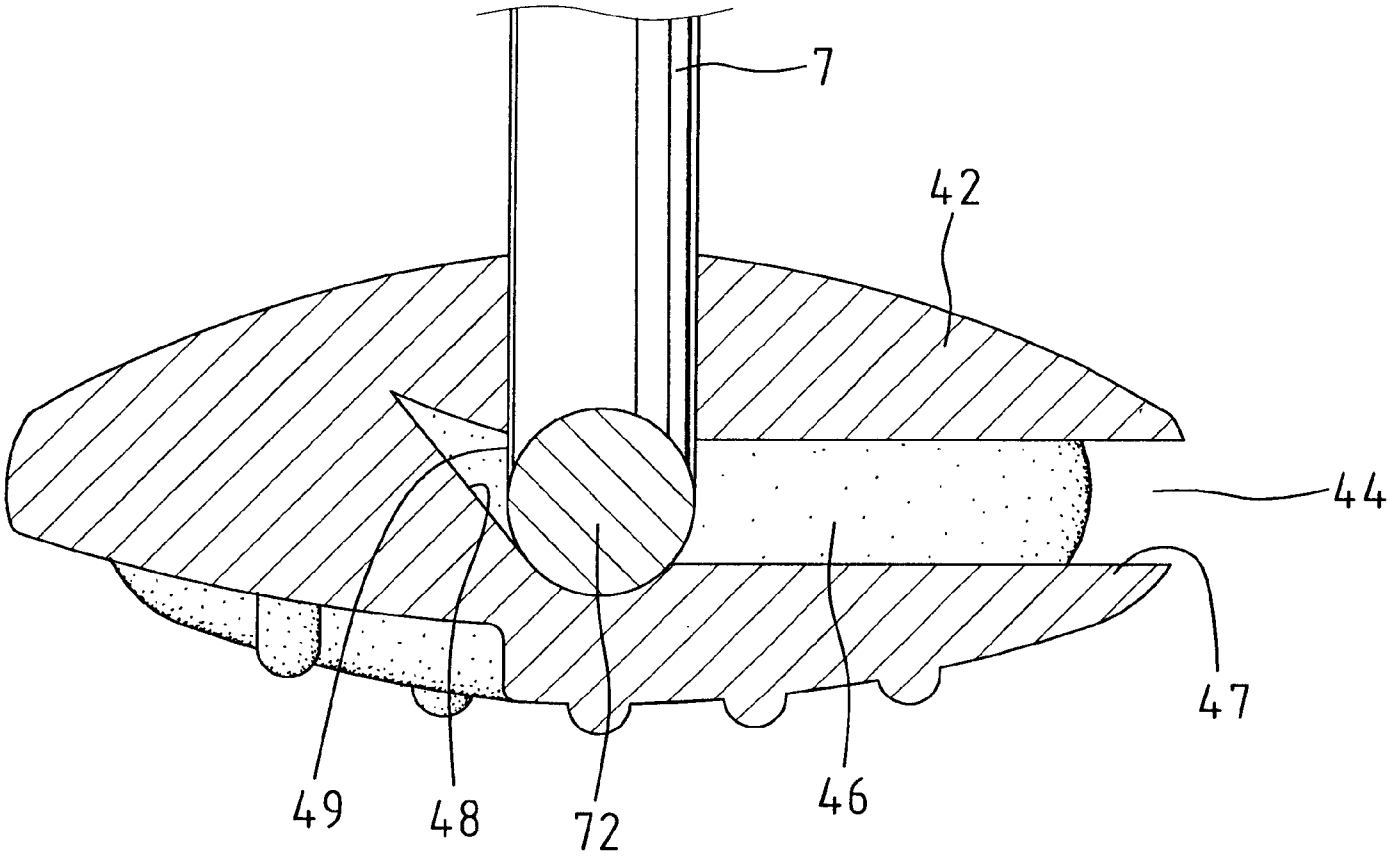
FIG. 4 is a sectional view of the support base and a resilient member.
Figure 5:
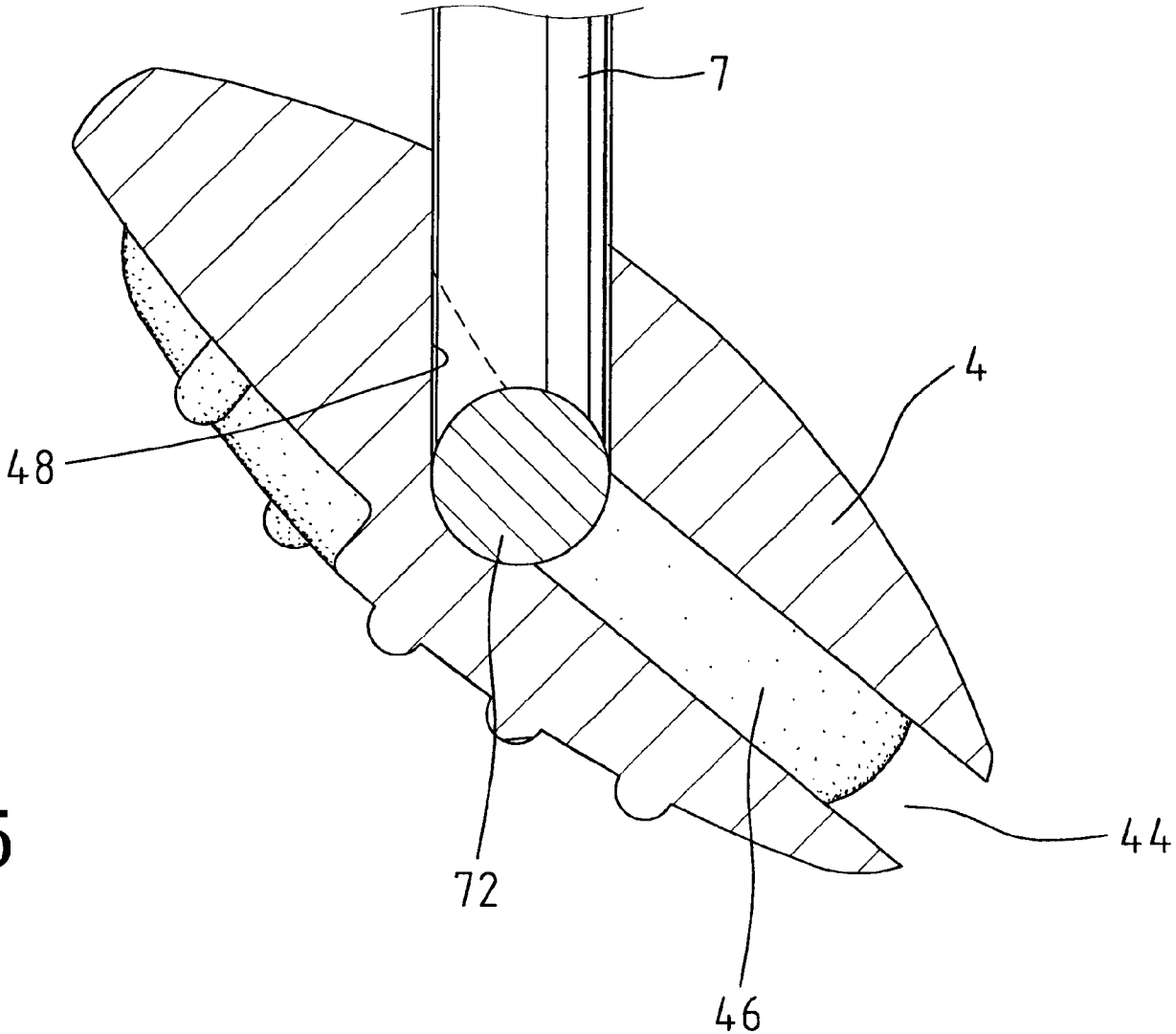
FIG. 5 is a sectional view similar to FIG. 4, wherein the resilient member is moved to a position for supporting the golf bag in a tilt status.
Figure 6:
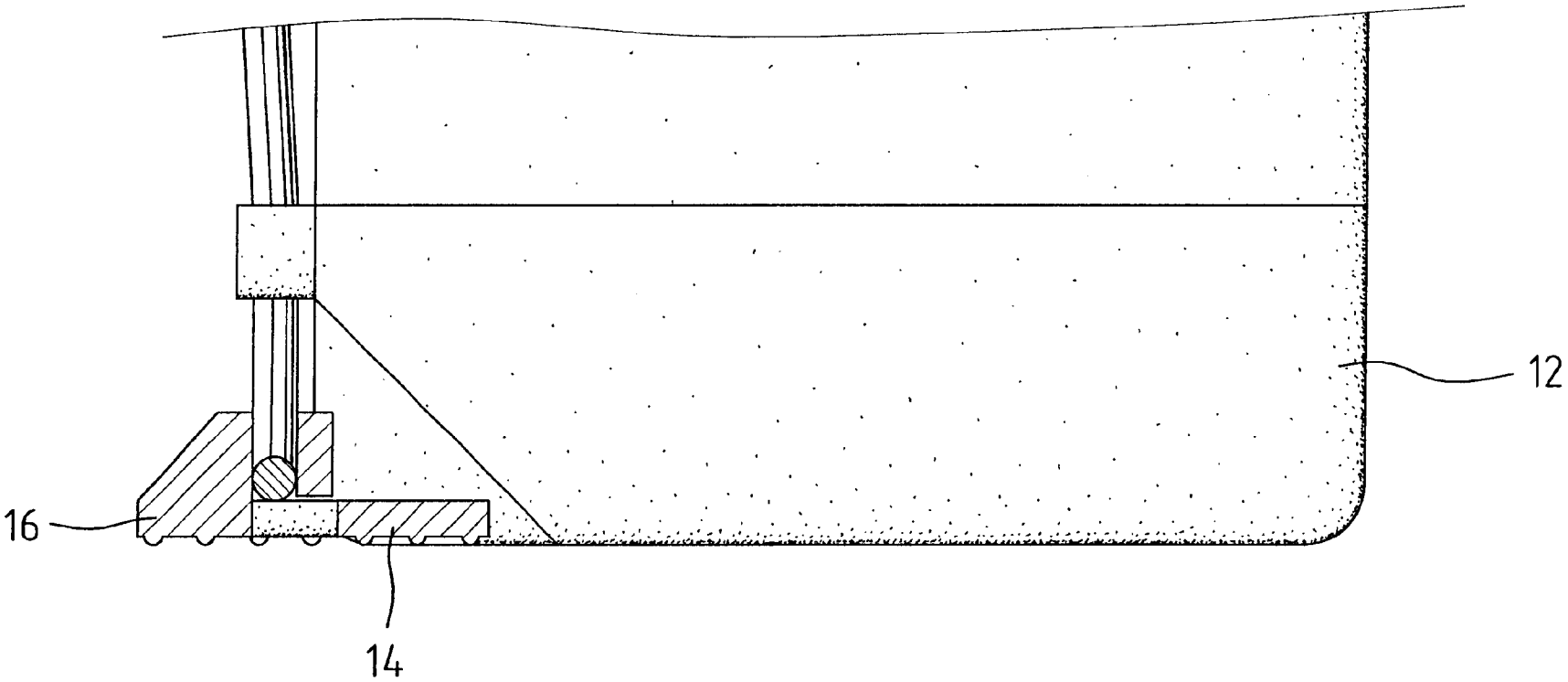
Fig. 6 PRIOR ART
FIG. 6 is a partial side view, partly sectioned, of a golf bag with a conventional support base.
Figure 7:
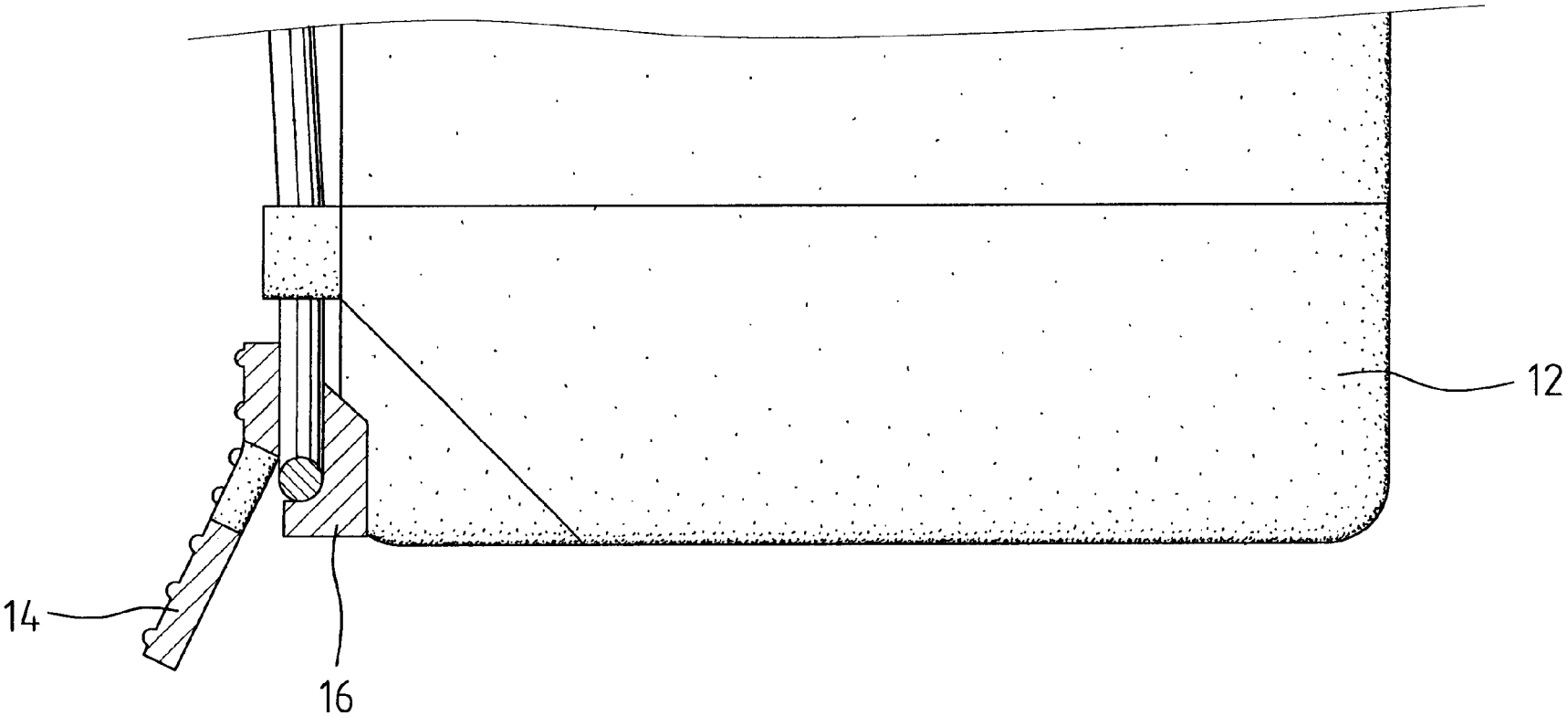
Fig. 7 PRIOR ART
FIG. 7 is a view similar to FIG. 6, wherein the golf bag is in an upright position.

In assembly, the mediate section 72 of the U-shape resilient member 7 is inserted into the support base 4 via the cutout 44 and the limbs 74 of the resilient member 7 are moved along the side passages 46 until the limbs 74 reach the inner ends 49 of the side passages 46, respectively, while the mediate section 72 of the resilient member 7 reaching the inner end of the cutout 44, as shown in FIG. 4. In use, the support base 4 is pivoted through an angle until the limbs 74 of the resilient member 7 enter the inclined grooves 48, respectively. Thus, the support base 4 may provide assistance in supporting the golf bag 1 in a tilt position.

The support base 4 is an integral unit that is preferably made of plastic material. In addition, the tongue 42 of the support base 4 is resilient and the cutout 44, except the inner end thereof, has a height slightly smaller than an outer diameter of the mediate section 72 of the resilient member 7. The closed inner ends 49 of the side passages 46 and an inner end of the cutout 44 together define a space for snugly and pivotally receiving the mediate section 72 of the resilient member 7. Namely, the inner end of the cutout 44 includes a height greater than the remaining portion of the cutout 44. Thus, the resilient member 7 is pivotally retained in the space after the resilient member 7 is forcibly inserted into the support base 4 via the cutout 44 and passed through the side passages 46.

The support base 4 in accordance with the present invention is rigid and pivotable relative to the resilient member 7 to thereby avoid breakage of the support base 4. Namely, breakage of the support base 4 that happens often in an upright status in the conventional designs is avoided, as the support base 4 tends to lie flat.

Although the invention has been explained in relation to its preferred embodiment, it is to be understood that many other possible modifications and variations can be made without departing from the scope of the invention as hereinafter claimed.

What is claimed is:

1. A support base adapted to be mounted to a golf bag having a substantially U-shaped resilient member defined by a mediate section and two limbs, the support base comprising: two parallel side passages in a top side thereof, the support base further comprising a cutout in a lateral side thereof, the cutout and the side passages communicating with each other and arranged to define a tongue with the side passages located on both sides of the tongue, each said side passage including an open outer end and a closed inner end, an end wall defining the inner end of each said side passage including an inclined groove, the cutout including an outer open end and an inner end that is aligned with the closed inner ends of the side passages, the mediate section of the resilient member being insertable into the inner end of the cutout until each of the limbs of the resilient member reaches the closed inner end of an associated one of said side passages, thereby allowing the limbs to be pivoted into said inclined grooves for supporting the golf bag in a tilted position.

2. The support base as claimed in claim 1, wherein the inner end of the cutout includes a height greater than a remaining portion of the cutout.

3. The support base as claimed in claim 2, wherein the mediate section of the resilient member is adapted to be pivotally received in the inner end of the cutout.

* * * * *